United States Patent [19]

Rodriquez

[11] 4,192,360

[45] Mar. 11, 1980

[54] SPOON DROPPER

[76] Inventor: Oswaldo J. Rodriquez, 5751 Riverdale Rd., Apt. 2E, College Park, Ga. 30349

[21] Appl. No.: 907,714

[22] Filed: May 19, 1978

[51] Int. Cl.[2] ..... B65B 3/30

[52] U.S. Cl. ..... 141/24; D7/141; D24/99; 30/141; 128/222; 141/98; 215/DIG. 5; 222/207

[58] Field of Search ..... D7/141; D24/99; 30/141, 30/324, 327; 128/222, 223, 233; 141/2, 18, 21, 25, 26, 84, 98, 369, 379, 380, 392, 22–24, 112; 215/228, DIG. 5; 222/191, 402.1, 207

[56] References Cited

U.S. PATENT DOCUMENTS 2,487,274 11/1949 Schaffer ..... 30/327 X

*Primary Examiner*—Frederick R. Schmidt

*Attorney, Agent, or Firm*—Jones, Thomas & Askew

[57] ABSTRACT

A measuring device has a cooperative plastic measuring liquid dropper dispensing a precise volume of liquid directly into an integral plastic spoon bowl. The spoon bowl is integrally foldably hinged to the dispensing tip of the medicine dropper by an integral plastic hinge. An integral plastic snap lock projection disposed on the outer surface of the dropper retains the spoon bowl in a compact storage position in a bottle of liquid.

3 Claims, 2 Drawing Figures

SPOON DROPPER

BACKGROUND OF THE INVENTION

The measuring device of this invention is classified in Classes 30/141, 141/380, 128/344, 141/18, D63/8, and the like.

Flanders, in U.S. Pat. No. 3,473,221 issued Oct. 21, 1969, discloses a baby feeding spoon having a bulb portion secured to a spoon bowl forcing air into the bowl portion and expelling food from the spoon bowl. Tenenouser, in U.S. Pat. No. 3,428,099 issued Feb. 18, 1969, discloses a dispenser for a pharmaceutical product including a dispensing bowl on a flexible arm. Further, in U.S. Pat. No. 3,259,132 issued on July 5, 1966, Katter discloses an air-activated utensil useful as an infant feeding spoon. Lisczawka discloses in U.S. Pat. No. Des. 203,143 issued Dec. 7, 1965, a medicine feeding spoon design.

SUMMARY OF THE INVENTION

An integral plastic measuring device has a flexible compressible bulb secured to a first terminus of a liquid dropper tube formed of a thermoplastic composition. The liquid dropper tube has the required volume and dispenses liquid drops on conventional manipulation of the flexible bulb. A plastic spoon bowl having the required volume is integrally secured to the second terminus of the liquid dropper tube adjacent to the dropper tube discharge orifice, an integral plastic hinge means foldably securing the dropper tube to the spoon bowl. The spoon bowl can be extended adjacent to the dropper tube discharge orifice. The spoon bowl can be folded at the hinge means, placing the spoon bowl substantially coplanarly adjacent to the liquid dropper tube, where the bowl can be locked to the tube by a flexible snap lock projection securing the bowl tip. The folded, compact measuring device can be stored in a bottle closed by a bottle cap conventionally secured to the measuring device.

Included in the objects of this invention are:

To provide a cooperative measuring device for dispensing a precise number of drops of medicine into a spoon bowl, the bowl being hingedly foldable for storage in a medicine bottle whose bottle cap conventionally secures the measuring device.

To provide a cooperative liquid dropper and foldable spoon bowl, hinged together and foldable for convenient storage in a bottle whose bottle cap secures the measuring device.

To provide measuring device for liquid dispensing having a dispensing liquid dropper cooperative with a spoon bowl suitable for receiving the precise number of liquid drops, the spoon bowl being foldable for storage in a bottle.

Other objects and advantages of this invention are taught in the following description and claims.

BRIEF DESCRIPTION OF THE DRAWINGS

The description of this invention is to be read in conjunction with the following drawings.

DESCRIPTION OF THE PREFERRED EMBODIMENT OF THE INVENTION

Figure 1:
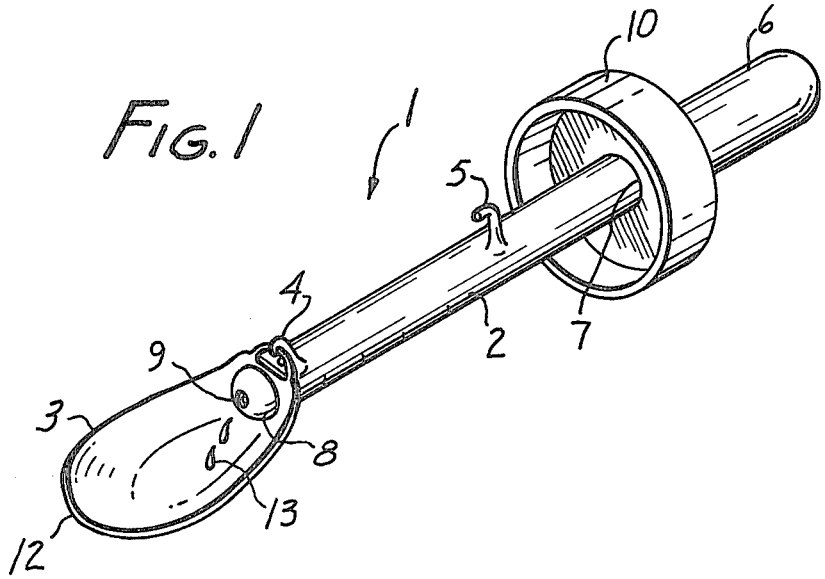
FIG. 1 is a pictorial elevational view of the measuring device of this invention, disposed in a useful operational position.

Referring to FIG. 1, the measuring device 1 of this invention is shown comprising a thermoplastic liquid dropper tube 2, a thermoplastic spoon bowl 3, an integral thermoplastic hinge means 4, and a flexible snap lock projection 5. The components tube 2, spoon bowl 3, hinge means 4, and the lock projection 5 are all formed of the same molded thermoplastic composition. The liquid dropper tube 2 has the desired dimension and dispenses the desired liquid volume into the spoon bowl 3. A flexible compressible bulb 6 is disposed and secured at the first terminus 7 of the tube 2, and the spoon bowl 3 is disposed at the second tube terminus 8. The second terminus 8 has a conventional orifice 9, from which the tube 2 dispenses liquid. The spoon bowl 3 is foldably secured to the tube 2 by the integral hinge means 4, the bowl 3 can be disposed confronting the orifice 9 and receive the liquid medicine from tube 2. The exterior of the liquid dropper tube 2 is shown adjacent the open spoon bowl 3, and it can be equivalently disposed connectingly adjacent the underside of the spoon bowl 3. A bottle cap 10 is disposed on the tube 2 in the conventional position adjacent to the flexible bulb 6, which is secured on tube terminus 7.

Figure 2:
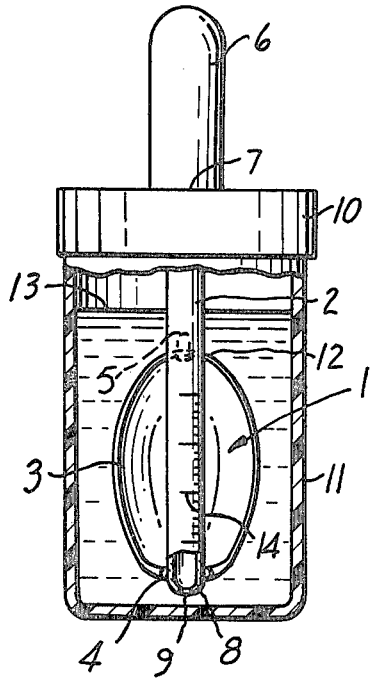
FIG. 2 is a partially broken away and sectional elevational view of the measuring device of this invention disposed in a bottle of liquid.

Operationally in FIG. 2, the measuring device 1 is shown disposed in the bottle 11, wherein the measuring device 1 is folded for compact and convenient storage. The spoon bowl 3 is secured in the compact folded state with the bowl tip 12 secured by the flexible snap lock projection 5. The tip 12 is the spoon bowl 3 segment opposed to the hinge means 4. The tube 2 of the device 1 can be filled by the bulb 6 in a conventional manner, and removed from the bottle 11. The spoon bowl 3 is then unfolded and extended as in FIG. 1, and receives the liquid medicine 13 dispensed in the required amount from the tube 2, as measured by the tube volume markings 14.

Many modifications in the measuring device can be made in the light of my teachings. It is understood that within the scope of the claims, the invention can be practiced otherwise than as described.

I claim:

1. A measuring device combination comprising:

a liquid dropper tube having a first tube terminus and having a flexible compressible bulb secured thereon, said dropper tube having a second tube terminus which includes a tube orifice, said dropper tube having a desired liquid volume, said dropper tube having a thermoplastic composition, a cap closure mounted on said liquid dropper tube, a hinge means integrally secured to said second tube terminus adjacent to said tube orifice, said hinge means having a thermoplastic composition, a spoon bowl integrally secured to said hinge means, said spoon bowl hingedly movable to accept liquid from said tube orifice, said spoon bowl having a thermoplastic composition and a bowl volume, and a flexible snap lock projection integrally secured to said dropper tube exterior, said projection being disposed at a position operative to provide a lock for a spoon bowl tip opposed to said hinge means, whereby said spoon bowl can be foldably secured coplanarly adjacent to said liquid dropper tube and locked there by said snap lock projection, prior to disposing said measuring device in a bottle for securing said cap closure.

2. The combination as in claim 1, wherein the interior of said spoon bowl is disposed confrontingly adjacent said liquid dropper tube during folded storage.

3. The combination as in claim 1, wherein the spoon bowl is disposed confrontingly adjacent said liquid dropper tube during folded storage.

* * * * *